US009167850B2

(12) United States Patent
Liu

(10) Patent No.: US 9,167,850 B2
(45) Date of Patent: Oct. 27, 2015

(54) ELECTRONIC CIGARETTE CASE

(71) Applicant: Qiuming Liu, Shenzhen (CN)

(72) Inventor: Qiuming Liu, Shenzhen (CN)

( * ) Notice: Subject to any disclaimer, the term of this patent is extended or adjusted under 35 U.S.C. 154(b) by 160 days.

(21) Appl. No.: 13/958,355

(22) Filed: Aug. 2, 2013

(65) Prior Publication Data

US 2015/0008150 A1 Jan. 8, 2015

(30) Foreign Application Priority Data

Jul. 2, 2013 (CN) ..... 2013 2 0390773 U

(51) Int. Cl.

*A24F 15/00* (2006.01)
*A24F 15/12* (2006.01)
*A24F 47/00* (2006.01)

(52) U.S. Cl.

CPC ..... *A24F 15/12* (2013.01); *A24F 47/008* (2013.01)

(58) Field of Classification Search

CPC ..... A24F 15/12; A24F 47/00
USPC ..... 206/268, 242, 276, 275, 259
See application file for complete search history.

(56) References Cited

U.S. PATENT DOCUMENTS

| | | | | |
|---|---|---|---|---|
| RE31,076 | E * | 11/1982 | Herman | 206/246 |
| 7,455,177 | B2 * | 11/2008 | Serafini et al. | 206/268 |
| 7,870,953 | B2 * | 1/2011 | Tanbo et al. | 206/268 |
| 2005/0224375 | A1 * | 10/2005 | Focke et al. | 206/259 |

* cited by examiner

*Primary Examiner* — Anthony Stashick
*Assistant Examiner* — Raven Collins
(74) *Attorney, Agent, or Firm* — Tim Tingkang Xia, Esq.; Locke Lord LLP

(57) ABSTRACT

This present invention relates to an electronic cigarette case comprising a cigarette case body (1). The cigarette case body (1) includes an accommodation structure (2). A first accommodation region configured for holding an electronic cigarette (100) is formed in the accommodation structure (2). A second accommodation region is formed between the outer surface of the accommodation structure (2) and the inner surface of the cigarette case body (1) and the second accommodation region is configured for receiving paper documents, especially an electronic cigarette operating instruction. The instruction can be taken out and inserted into the electronic cigarette case easily, and it is convenient for users to use. Furthermore, in assembly, the instruction can be directly inserted into the electronic cigarette case, which brings great convenience for the production and improves the production efficiency.

11 Claims, 7 Drawing Sheets

ELECTRONIC CIGARETTE CASE

CROSS-REFERENCE TO RELATED APPLICATIONS

This non-provisional application claims priorities under 35 U.S.C. §119(a) on Patent Application No. 201320390773.6 filed in P.R. China on Jul. 2, 2013, the entire contents of which are hereby incorporated by reference.

FIELD OF THE INVENTION

This present invention relates to the field of electronic cigarettes, and more particularly to an electronic cigarette case.

BACKGROUND OF THE INVENTION

At present, more and more persons like to use electronic cigarettes as the substitute of real cigarettes. The reason is that the electronic cigarettes have the same appearances as cigarettes and taste similar to cigarettes, and thus can meet tobacco addictions of smokers without changing their habitual behaviors.

Similar to cigarettes, an electronic cigarette is generally equipped with an electronic cigarette case configured for accommodating the electronic cigarette, and is further equipped with an electronic cigarette operating instruction. In the prior art, the electronic cigarette operating instruction is usually rolled up and received in the same space of the electronic cigarette case together with the electronic cigarette. When the instruction needs to be taken out, it must be taken out together with the electronic cigarette. Thus, the instruction may wrinkle and be inconvenient for users to read. Furthermore, it is also difficult to persist the instruction for use at any time or put the instruction back to the electronic cigarette case. Additionally, when the electronic cigarette case is produced, the assembly work is complicated, and the production efficiency is decreased.

SUMMARY OF THE INVENTION

The object of the present invention is to provide an electronic cigarette case configured for putting into and taking out the electronic cigarette operating instruction conveniently and assembling the instruction easily, and thereby solve the problem that the aforementioned electronic cigarette case in the prior art is inconvenient for users to use and complicated to assemble, and causes the production efficiency to be decreased.

In order to realize the object mentioned above, an electronic cigarette case is provided, comprising a cigarette case body which includes an accommodation structure, a first accommodation region configured for holding an electronic cigarette is formed in the accommodation structure, and a second accommodation region is formed between an outer surface of the accommodation structure and an inner surface of the cigarette case body.

The accommodation structure is inserted into and placed inside the cigarette case body, the outer surface of the accommodation structure and the inner surface of the cigarette case body are partially or wholly separated from each other to form a gap space, and the gap space forms the second accommodation region, and the second accommodation region is configured to receive a paper document by insertion.

A width of the gap between the outer surface of the accommodation structure and the inner surface of the cigarette case body is 0.5-5 millimeters.

A cross-section of the gap space is any one of bar-shaped, L-shaped, U-shaped, camber-shaped, and end-to-end closing-shaped.

The gap space is formed by a gap between the outer surface of the accommodation structure and one corresponding side wall of the inner surface of the cigarette case body, and the cross-section of the gap space is bar-shaped.

The gap space is formed by a gap between the outer surface of the accommodation structure and two adjacent corresponding side walls of the inner surface of the cigarette case body, and the cross-section of the gap space is L-shaped.

The gap space is formed by a gap between the outer surface of the accommodation structure and three adjacent corresponding side walls of the inner surface of the cigarette case body, and the cross-section of the gap space is U-shaped.

The accommodation structure is positioned in a middle portion of the cigarette case body, the gap space is formed by a gap between the outer surface of the accommodation structure and the inner surface of the cigarette case body, and the cross-section of the gap space is end-to-end closing-shaped.

The gap space extends to a bottom of the cigarette case body along a direction for inserting the electronic cigarette into the cigarette case body.

The accommodation structure is detachably connected to the bottom of cigarette case body.

The accommodation structure comprises a first combining part, a second combining part, and a holding cavity which forms the first accommodation region, and the holding cavity is formed between the first combining part and the second combining part.

The electronic cigarette case further comprises a seal cartridge and a lock piece, the seal cartridge is embedded in the second combining part, a through hole is defined in the bottom of the cigarette case body, and the lock piece passes through the through hole and is connected with the second combining part to hold the accommodation structure in the cigarette case body.

The electronic cigarette case further comprises a case cover rotationally connected to the cigarette case body.

The case cover is rotationally connected to the cigarette case body by a connection part.

The connection part is integrally formed with both the cigarette case body and the case cover.

The first combining part includes a protrusion part extending out of the cigarette case body, the protrusion part includes a first protrusion surface, a second protrusion surface, and a third protrusion surface, the second protrusion surface and the third protrusion surface are respectively formed at ends of two side walls of the protrusion part that are both adjacent to the first protrusion surface.

A side of the first protrusion surface that is opposite to the connection part protrudes from the cigarette case body.

An outer side of the second protrusion surface and/or an outer side of the third protrusion surface defines at least one groove, an inner wall of the case cover corresponding to the second protrusion surface and/or the third protrusion surface forms a bulge corresponding to the groove, and the groove is buckled with the bulge.

The outer side of the second protrusion surface and/or the third protrusion surface defines at least one bulge, the inner wall of the case cover corresponding to the second protrusion surface and/or the third protrusion surface forms a groove corresponding to the bulge, and the bulge is buckled with the groove.

By adopting the electronic cigarette case of the present invention, the following advantages can be achieved:

In the present invention, by setting an independent accommodation region configured for holding the electronic cigarette operating instruction in the electronic cigarette case, the instruction can be taken out and inserted into the electronic cigarette case easily, and it is convenient for users to use. Furthermore, in assembly, the instruction can be directly inserted into the electronic cigarette case, which brings great convenience for the production and improves the production efficiency.

DETAILED DESCRIPTION OF THE PREFERRED EMBODIMENT

Figure 1:
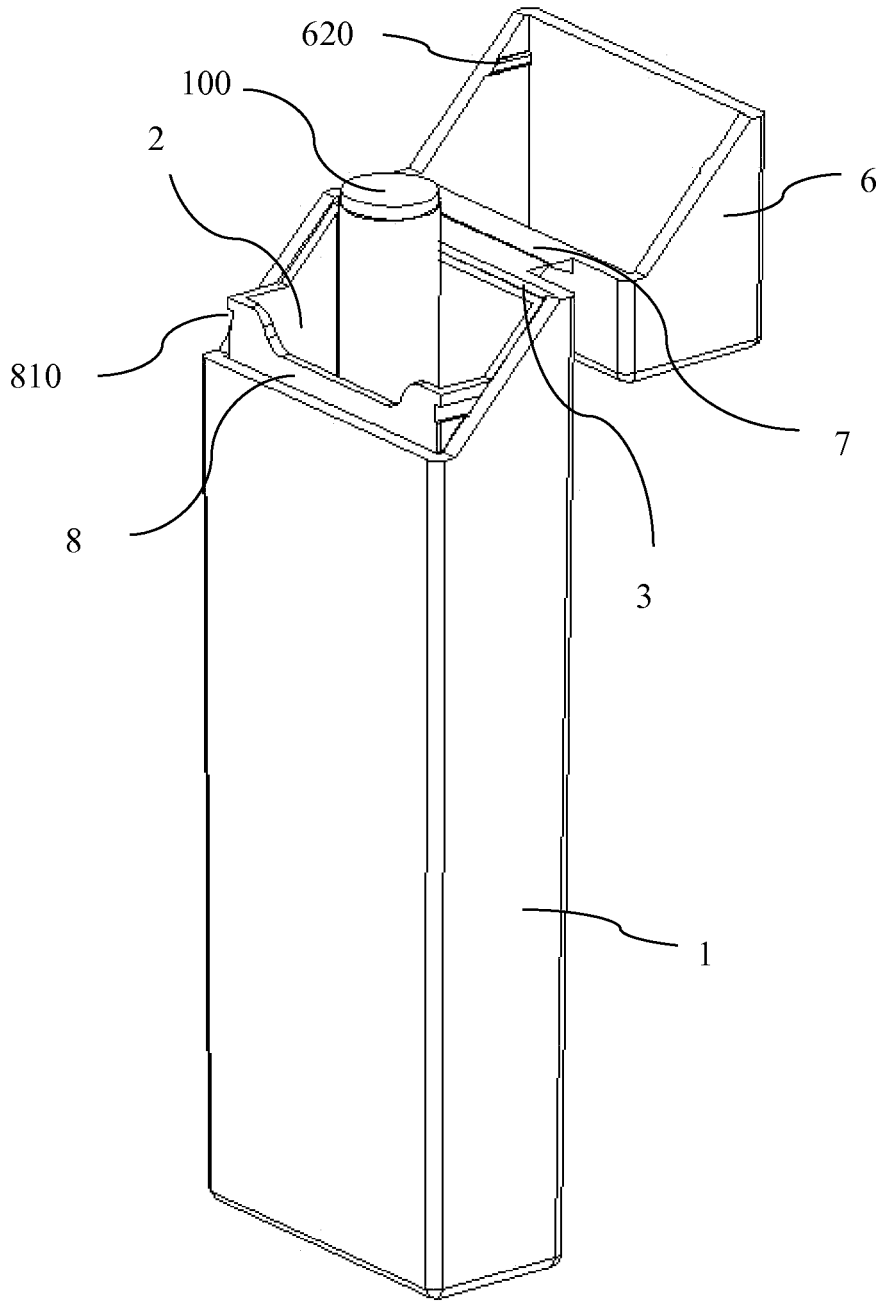
FIG. 1 is a schematic structural view of an electronic cigarette case of a preferred embodiment of the present invention, wherein the electronic cigarette case is in an open state.

In order to understand the technical features, purpose and the effect of the present invention more clearly, the preferred specific embodiments of the present invention will be described referring to the drawings.

Figure 2:
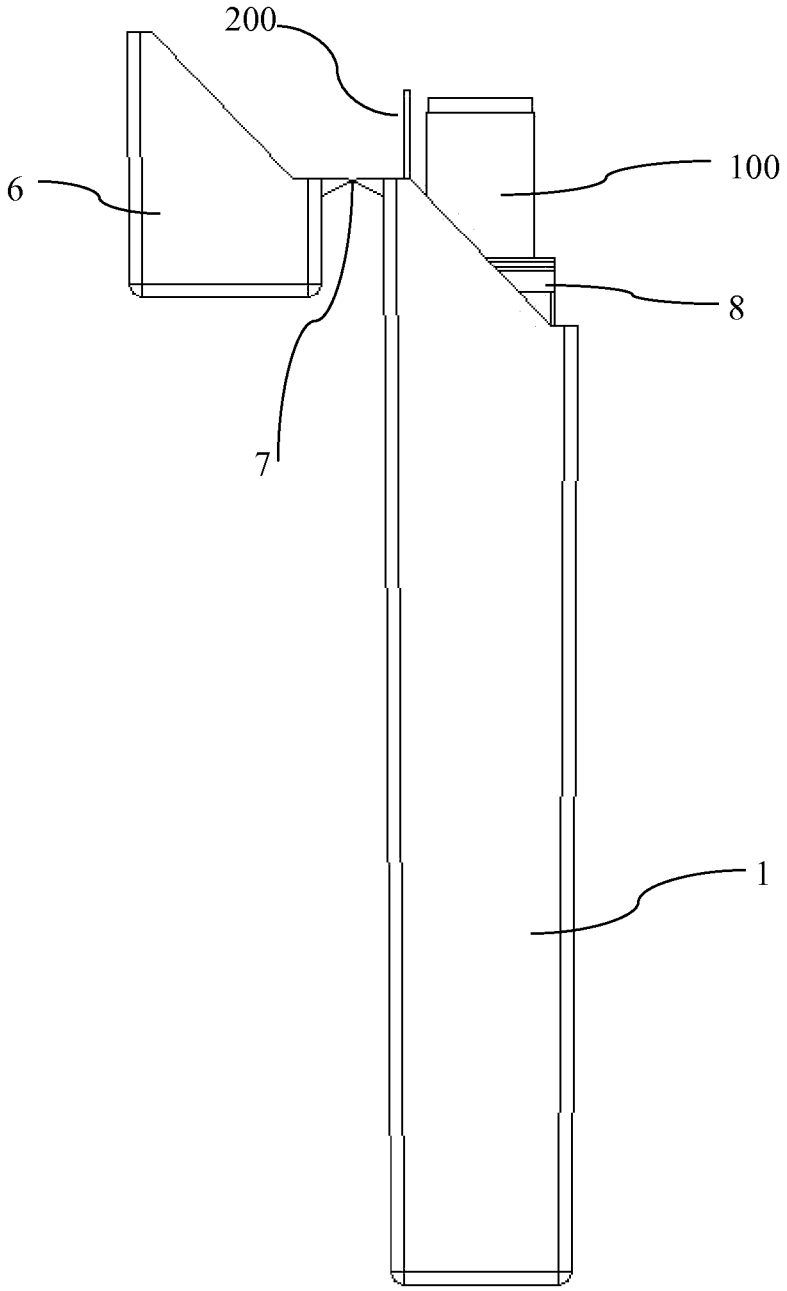
FIG. 2 is a schematic side view of the electronic cigarette case of the preferred embodiment of the present invention, wherein the electronic cigarette case is in the open state.

Referring to FIG. 1 and FIG. 2, an electronic cigarette case comprises a cigarette case body 1. One end of the cigarette case body 1 defines an opening, and a section of the opening is a slope. A case cover 6 is mounted at one side of the opening of the cigarette case body 1, and is rotationally connected to the cigarette case body 1 by a connection part 7. The cigarette case 6 includes another slope matching the opening of the cigarette case body 1. The connection part 7 can be a hinge, a connection part with an independent folder, and so on, and can also be integrally formed with the cigarette case body 1 and the case cover 6, as shown in FIG. 1 and FIG. 2.

The cigarette case body 1 receives an accommodation structure 2, and the accommodation structure 2 includes a protrusion part 8 extending out of the cigarette case body 1.

A first accommodation region configured for holding at least one electronic cigarette 100 (wherein, the first accommodation is not labeled in the drawings; the first accommodation region is configured for holding at least one electronic cigarette 100, and the number of the held electronic cigarette 100 can be determined according to the size of the cigarette case) is formed in the accommodation structure 2. A second accommodation region (not labeled in the drawings) is formed between an outer surface of the accommodation structure 2 and an inner surface of the cigarette case body 1.

Figure 3:
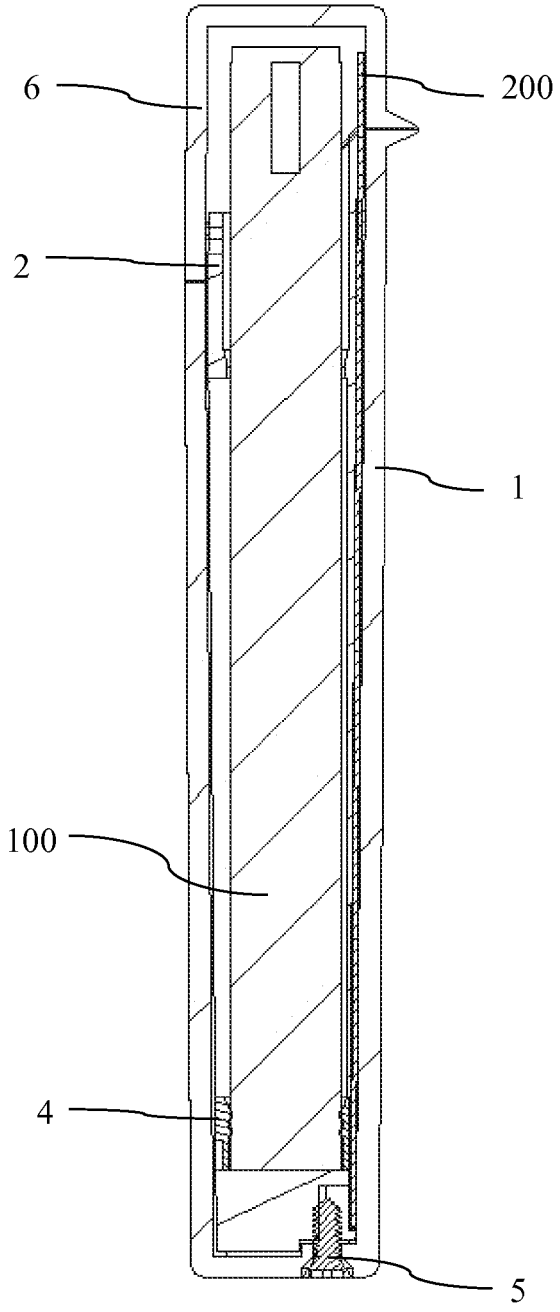
FIG. 3 is a schematic cut-away view of the electronic cigarette case of the preferred embodiment of the present invention, wherein the electronic cigarette case is in a close state.
Figure 4:
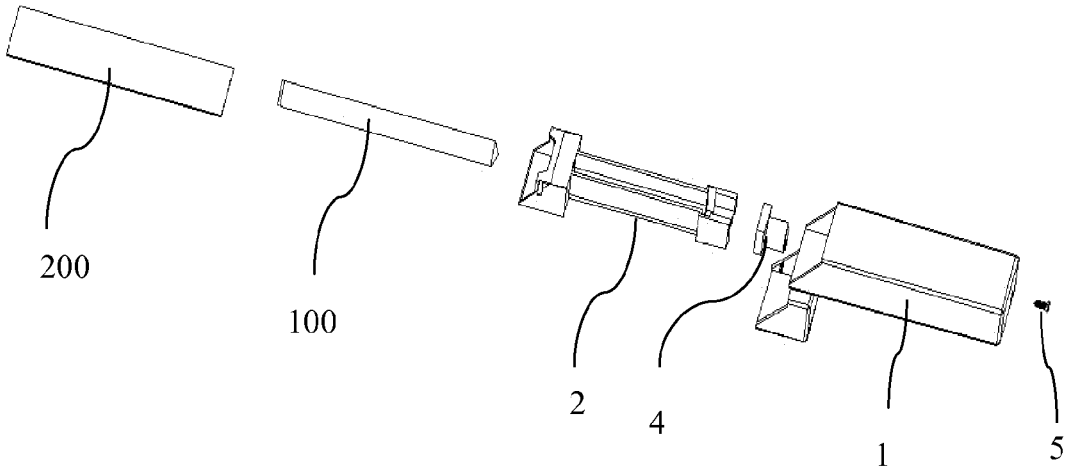
FIG. 4 is an exploded structural view of the electronic cigarette case of the preferred embodiment of the present invention.
Figure 5:
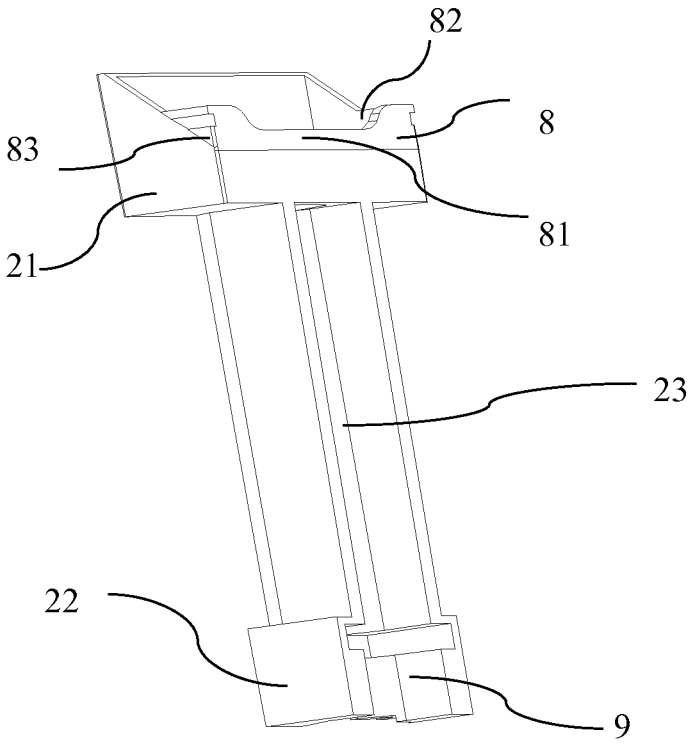
FIG. 5 is a schematic structural view of an accommodation structure of the present invention.

Referring to FIG. 5, the accommodation structure 2 includes a first combining part 21, a second combining part 22, and a holding cavity 23. The first accommodation region is formed by the holding cavity 23. The holding cavity 23 is formed between the first combining part 21 and the second combining part 22, and the shape of the holding cavity 23 matches the external shape of the electronic cigarette 100. Referring to FIG. 3 and FIG. 4, the accommodation structure 2 is inserted into and placed in the cigarette case body 1, and a seal cartridge 4 is embedded in the second combining part 22. A through hole (not labeled in the drawings) is defined in a bottom of the cigarette case body 1 that is far away from the opening, and a lock piece 5 passes through the through hole and is connected to the second combining part 22. Thus, the accommodation structure 2 is mounted inside the cigarette case 1 detachably by the lock piece 5. The lock piece 5 can be a screw or a bolt.

Referring to FIG. 1, a gap space 3 with a width ranged from 0.5-5 millimeters is formed between the outer surface of the accommodation structure 2 and the inner surface of the cigarette case body 1, and thereby forms the second accommodation region. Referring to FIGS. 2-4, the gap space 3 is configured to receive a paper document 200, which is generally an electronic cigarette operating instruction, an electronic cigarette certification, and so on.

The gap space 3 includes various forms:

When a first gap is formed between the outer surface of the accommodation structure 2 and one corresponding side wall of the inner surface of the cigarette case body 1, and the outer surface of the accommodation structure 2 is in contact with the other corresponding side walls of the inner surface of the cigarette case body 1, the gap space 3 with a bar-shaped cross-section is formed by the first gap.

When a second gap is formed between the outer surface of the accommodation structure 2 and two adjacent corresponding side walls of the inner surface of the cigarette case body 1, and the outer surface of the accommodation structure 2 is in contact with the other corresponding side walls of the inner surface of the cigarette case body 1, the gap space 3 with an L-shaped cross-section is formed by the second gap.

When a third gap is formed between the outer surface of the accommodation structure 2 and three adjacent corresponding side walls of the inner surface of the cigarette case body 1, and the outer surface of the accommodation structure 2 is in contact with the other corresponding side walls of the inner surface of the cigarette case body 1, the gap space 3 with a U-shaped cross-section is formed by the third gap.

When the accommodation structure 2 is positioned in a middle portion of the cigarette case body 1, and none of the side walls of the inner surface of the cigarette case body 1 is in contact with the outer surface of the accommodation structure 2, the gap space 3 with an end-to-end closing-shaped cross-section is formed by a fourth gap between the outer surface of the accommodation structure 2 and the inner surface of the cigarette case body 1.

When the outer surface of the accommodation structure 2 and the inner surface of the cigarette case body 1 are both camber curved surfaces, and a fifth gap is formed between the outer surface of the accommodation structure 2 and a corresponding part of the inner surface of the cigarette case body 1, the gap space 3 with a camber-shaped cross-section is formed by the fifth gap.

Preferably, the gap space 3 is formed by the first gap between the outer surface of the accommodation structure 2 and one corresponding side wall of the inner surface of the cigarette case body 1, and the cross-section of the gap space 3 is bar-shaped. The gap space 3 can be formed at the same side of the cigarette case body 1 as the connection part 7, and can also be formed at a side of the cigarette case body 1 that is opposite to the connection part 7.

Furthermore, the gap space 3 extends to a bottom of the cigarette case body 1 along a direction for inserting the electronic cigarette 100 into the cigarette case body 1.

Referring to FIG. 1, the first combining part 21 of the accommodation structure 2 includes a protrusion part 8 extending out of the cigarette case body 1, and the protrusion part is generally U-shaped. Referring to FIG. 5, the protrusion part 8 includes a first protrusion surface 81, a second protrusion surface 82, and a third protrusion surface 83. A side of the first protrusion surface 81 that is opposite to the connection part 7 protrudes from the cigarette case body 1. The second protrusion surface 82 and the third protrusion surface 83 are respectively formed at ends of two side walls of the protrusion part 8 that are both adjacent to the first protrusion surface 81.

Figure 6:
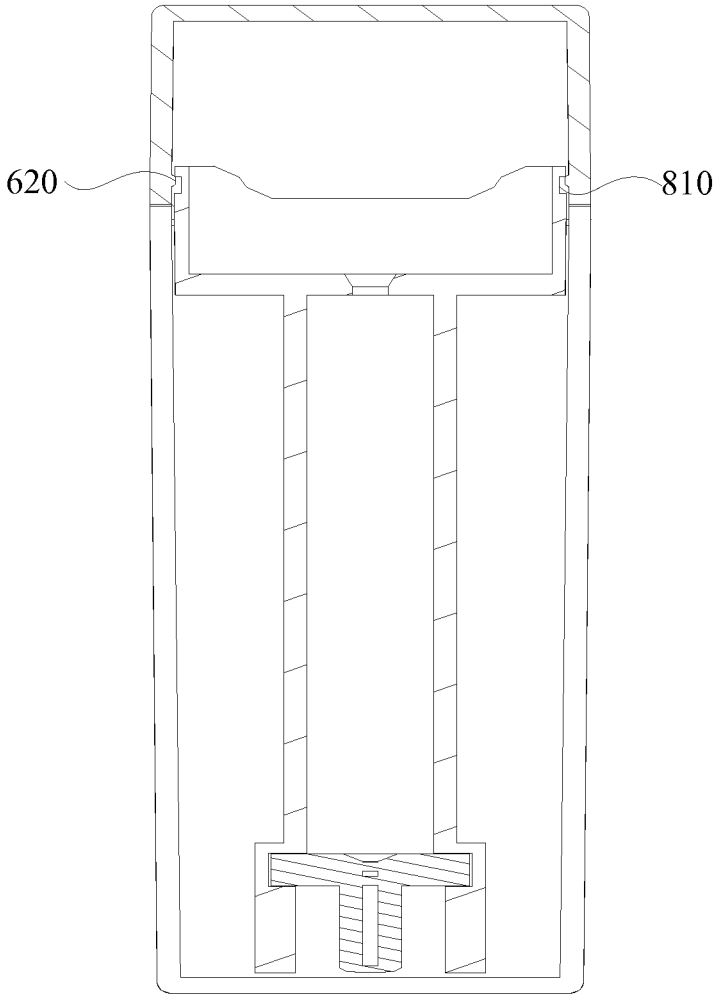
FIG. 6 is a schematic cut-away view of one buckle connection between a case cover and the accommodation structure of the present invention.

Referring to FIG. 6, an outer side of the second protrusion surface 82 and/or an outer side of the third protrusion surface 83 can define at least one groove 810, an inner wall of the case cover 6 corresponding to the second protrusion surface 82 and/or the third protrusion surface 83 can form at least one bulge 620 corresponding to the groove 810, and the groove 810 is buckled with the bulge 620.

Figure 7:
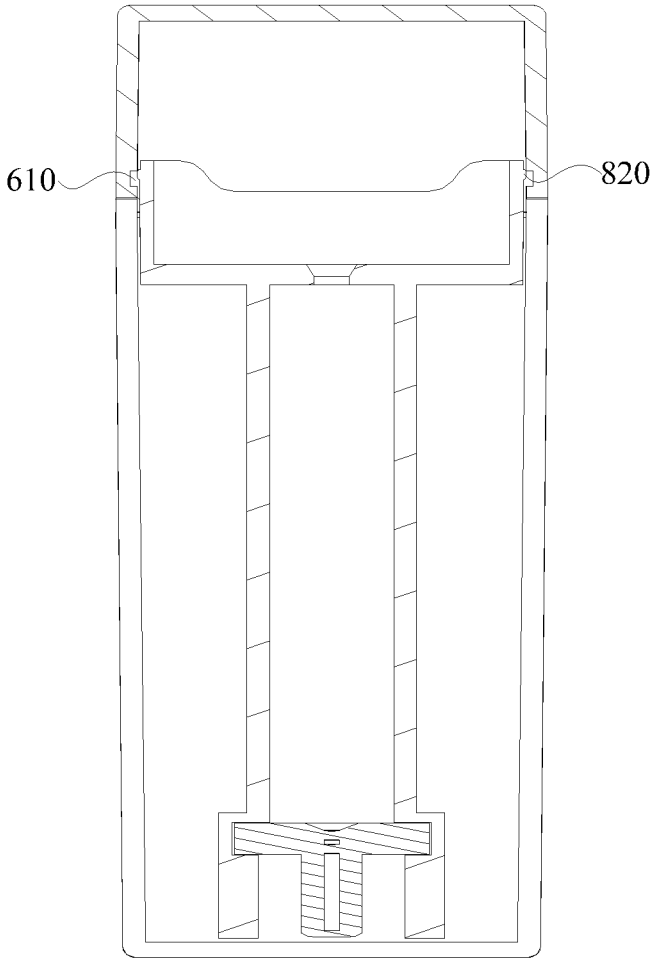
FIG. 7 is a schematic cut-away view of another buckle connection between the case cover and the accommodation structure of the present invention.

Referring to FIG. 7, the outer side of the second protrusion surface 82 and/or the third protrusion surface 83 can also define at least one bulge 820, the inner wall of the case cover 6 corresponding to the second protrusion surface 82 and/or the third protrusion surface 83 can also form at least one groove 610 corresponding to the bulge 820, and the bulge 820 is buckled with the groove 610.

In addition, the case cover 6 can be connected to the accommodation structure 2 by magnetic attraction or other kinds of connections, so as to connect the case cover 6 with the cigarette case body 1. The case cover 6 can also be directly connected to the cigarette case body 1 by magnetic attraction or other kinds of connections.

In the present invention, by setting the second accommodation region configured for receiving the electronic cigarette operating instruction in the electronic cigarette case, that is, the gap space 3 formed between the outer surface of the accommodation structure 2 and the inner surface of the cigarette case body 1, the instruction can be taken out and inserted into the electronic cigarette case easily, and it is convenient for users to use. Furthermore, in assembly, the instruction can be directly inserted into the electronic cigarette case, which brings great convenience for the production and improves the production efficiency.

While the present invention has been described with the drawings to preferred embodiments which is merely a hint rather than a limit, it will be understood by those skilled in the art that various changes may be made and equivalents may be substituted without departing from the scope of the present invention. But all the changes will be included within the scope of the appended claims.

What is claimed is:

1. An electronic cigarette case comprising a cigarette case body, a seal cartridge and a lock piece, wherein, the cigarette case body includes an accommodation structure, a first accommodation region configured for holding an electronic cigarette is formed in the accommodation structure, and a second accommodation region is formed between an outer surface of the accommodation structure and an inner surface of the cigarette case body;

wherein, the accommodation structure is detachably connected to the bottom of the cigarette case body;

wherein, the accommodation structure comprises a first combining part, a second combining part, and a holding cavity which forms the first accommodation region, and the holding cavity is formed between the first combining part and the second combining part; and wherein, the seal cartridge is embedded in the second combining part, a through hole is defined in the bottom of the cigarette case body, and the lock piece passes through the through hole and is connected with the second combining part to hold the accommodation structure in the cigarette case body.

2. The electronic cigarette case of claim 1, wherein, the accommodation structure is inserted into and placed inside the cigarette case body, the outer surface of the accommodation structure and the inner surface of the cigarette case body are partially or wholly separated from each other to form a gap space, and the gap space forms the second accommodation region, and the second accommodation region is configured to receive a paper document by insertion.

3. The electronic cigarette case of claim 2, wherein, a width of the gap between the outer surface of the accommodation structure and the inner surface of the cigarette case body is 0.5-5 millimeters.

4. The electronic cigarette case of claim 2, wherein, a cross-section of the gap space is any one of bar-shaped, L-shaped, U-shaped, camber-shaped, and end-to-end closing-shaped.

5. The electronic cigarette case of claim 4, wherein, the gap space is formed by a gap between the outer surface of the accommodation structure and one corresponding side wall of the inner surface of the cigarette case body, and the cross-section of the gap space is bar-shaped.

6. The electronic cigarette case of claim 4, wherein, the gap space is formed by a gap between the outer surface of the accommodation structure and two adjacent corresponding side walls of the inner surface of the cigarette case body, and the cross-section of the gap space is L-shaped.

7. The electronic cigarette case of claim 4, wherein, the gap space is formed by a gap between the outer surface of the accommodation structure and three adjacent corresponding side walls of the inner surface of the cigarette case body, and the cross-section of the gap space is U-shaped.

8. The electronic cigarette case of claim 4, wherein, the accommodation structure is positioned in a middle portion of the cigarette case body, the gap space is formed by a gap between the outer surface of the accommodation structure and the inner surface of the cigarette case body, and the cross-section of the gap space is end-to-end closing-shaped.

9. The electronic cigarette case of claim 5, wherein, the gap space extends to a bottom of the cigarette case body along a direction for inserting the electronic cigarette into the cigarette case body.

10. An electronic cigarette case comprising a cigarette case body and a case cover rotationally connected to the cigarette case body, wherein, the cigarette case body includes an accommodation structure, a first accommodation region configured for holding an electronic cigarette is formed in the accommodation structure, and a second accommodation region is formed between an outer surface of the accommodation structure and an inner surface of the cigarette case body;

wherein, the accommodation structure is detachably connected to the bottom of the cigarette case body;

wherein, the accommodation structure comprises a first combining part, a second combining part, and a holding cavity which forms the first accommodation region, and the holding cavity is formed between the first combining part and the second combining part;

wherein, the case cover is rotationally connected to the cigarette case body by a connection part which is integrally formed with both the cigarette case body and the case cover;

wherein, the first combining part includes a protrusion part extending out of the cigarette case body, the protrusion part includes a first protrusion surface, a second protrusion surface, and a third protrusion surface, the second protrusion surface and the third protrusion surface are respectively formed at ends of two side walls of the protrusion part that are both adjacent to the first protrusion surface;

wherein, a side of the first protrusion surface that is opposite to the connection part protrudes from the cigarette case body; and wherein, an outer side of the second protrusion surface and/or an outer side of the third protrusion surface define at least one groove, an inner wall of the case cover corresponding to the second protrusion surface and/or the third protrusion surface forms a bulge corresponding to the groove, and the groove is buckled with the bulge.

11. An electronic cigarette case comprising a cigarette case body and a case cover rotationally connected to the cigarette case body, wherein, the cigarette case body includes an accommodation structure, a first accommodation region configured for holding an electronic cigarette is formed in the accommodation structure, and a second accommodation region is formed between an outer surface of the accommodation structure and an inner surface of the cigarette case body;

wherein, the accommodation structure is detachably connected to the bottom of the cigarette case body;

wherein, the accommodation structure comprises a first combining part, a second combining part, and a holding cavity which forms the first accommodation region, and the holding cavity is formed between the first combining part and the second combining part;

wherein, the case cover is rotationally connected to the cigarette case body by a connection part which is integrally formed with both the cigarette case body and the case cover;

wherein, the first combining part includes a protrusion part extending out of the cigarette case body, the protrusion part includes a first protrusion surface, a second protrusion surface, and a third protrusion surface, the second protrusion surface and the third protrusion surface are respectively formed at ends of two side walls of the protrusion part that are both adjacent to the first protrusion surface;

wherein, a side of the first protrusion surface that is opposite to the connection part protrudes from the cigarette case body; and wherein, an outer side of the second protrusion surface and/or an outer side of the third protrusion surface define at least one bulge, an inner wall of the case cover corresponding to the second protrusion surface and/or the third protrusion surface forms a groove corresponding to the bulge, and the bulge is buckled with the groove.

* * * * *